United States Patent [19]

Willis

[11] 4,455,913

[45] Jun. 26, 1984

[54] COLLAPSABLE DRUM

[76] Inventor: Ward L. Willis, P.O. Box 95, Breinigsville, Pa. 18031

[21] Appl. No.: 419,982

[22] Filed: Sep. 20, 1982

[51] Int. Cl.[3] ..... G10D 13/02

[52] U.S. Cl. ..... 84/412

[58] Field of Search ..... 84/411–421

[56] References Cited

U.S. PATENT DOCUMENTS 859,036 7/1907 Baggs .
1,113,253 10/1914 Schreiner ..... 84/412
1,768,438 6/1930 Clark ..... 84/412
2,546,452 3/1951 Kmieliauskas ..... 84/412

FOREIGN PATENT DOCUMENTS 662798 4/1964 Italy ..... 84/419

*Primary Examiner*—Lawrence R. Franklin

[57] ABSTRACT

A drum shell collapsable for storage and transport characterized by easily fabricated ring-like shell portions nestable within the height of a main shell ring. The drum includes internal means to maintain the drum in its open position.

4 Claims, 5 Drawing Figures

FIG. 1
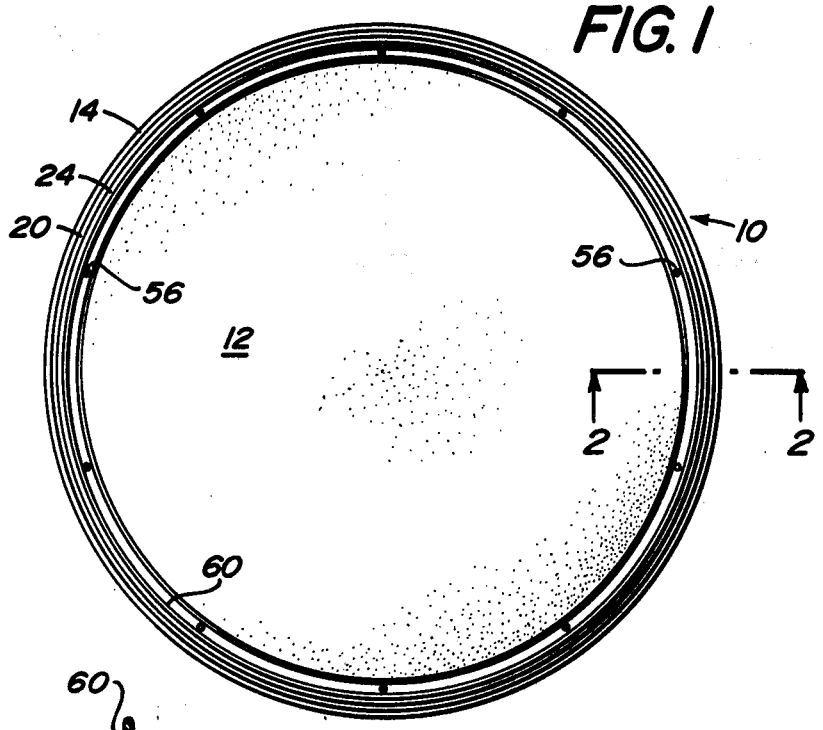
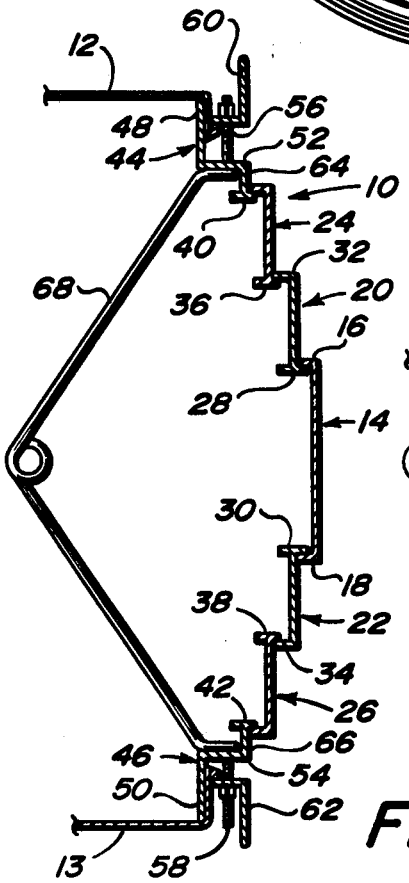
FIG. 2
FIG. 3
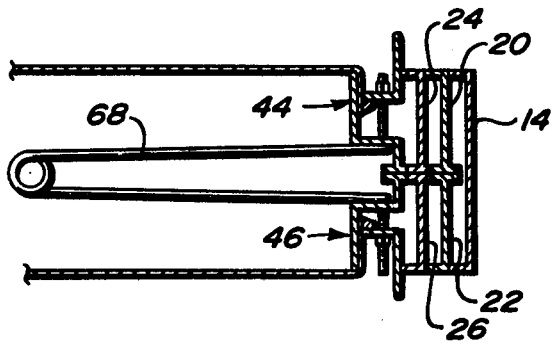

COLLAPSABLE DRUM

TECHNICAL FIELD

The present invention pertains to a collapsable drum or drum set of the type commonly used by professional bands. Many attempts have been made to provide a collapsable drum or a foldable drum, one that is smaller in size to facilitate storage and transportation.

BACKGROUND OF THE PRIOR ART

U.S. Pat. No. 859,036 discloses an early attempt at reducing the storage and transportation space of a drum by providing a foldable drum.

U.S. Pat. No. 1,113,253 discloses and claims a collapsable drum requiring a cumbersome out side structure to maintain the drum in its open or playing position.

U.S. Pat. No. 1,768,438 discloses and claims a collapsable drum made up of a plurality of shell rings each requiring hook-shaped extremities to determine the movement of the shell rings when the drum is in its open position. The weight of the rings are used to maintain the drum in its open position, thus requiring the upper head receiving ring to hold the drum in a playing position.

Lastly, U.S. Pat. No. 2,546,452 discloses a collapsable drum having nestable shell sections wherein there is a complicated spring mechanism to hold the shell sections in an open position for playing the drum.

BRIEF SUMMARY OF THE PRESENT INVENTION

The present invention provides for a main shell ring with a channel-shaped cross section, the flanges of the channel being disposed inwardly toward the inside of the drum shell when the drum is extended into the open or playing position, and at least one pair of intermediate shell rings having an outwardly extending flange on one end and an inwardly extending flange on the other end. The outwardly extending flanges mate with the flanges of the main shell ring to determine the position of the intermediate rings when the drum is in the playing position. A pair of drum head supporting means (rings) having a head supporting ring and a leg depending from a horizontal flange on the head supporting ring portion are the outermost members or shells of the multiple shell ring drum assembly. The depending legs of the drum head supporting rings have an outwardly turned lip to mate with and determine the position of the intermediate ring when the drum is in the open or playing position and means to urge the head portions to the maximum position for playing of the drum.

BRIEF DESCRIPTION OF THE DRAWING

FIG. 1 is a top plan view of the drum according to the present invention.

FIG. 2 is a section taken along lines 2—2 of FIG. 1.

FIG. 3 shows the section of FIG. 2 in the collapsed or storage position of the drum of FIG. 1.

DETAILED DESCRIPTION OF THE PREFERRED EMBODIMENT

Figure 4:
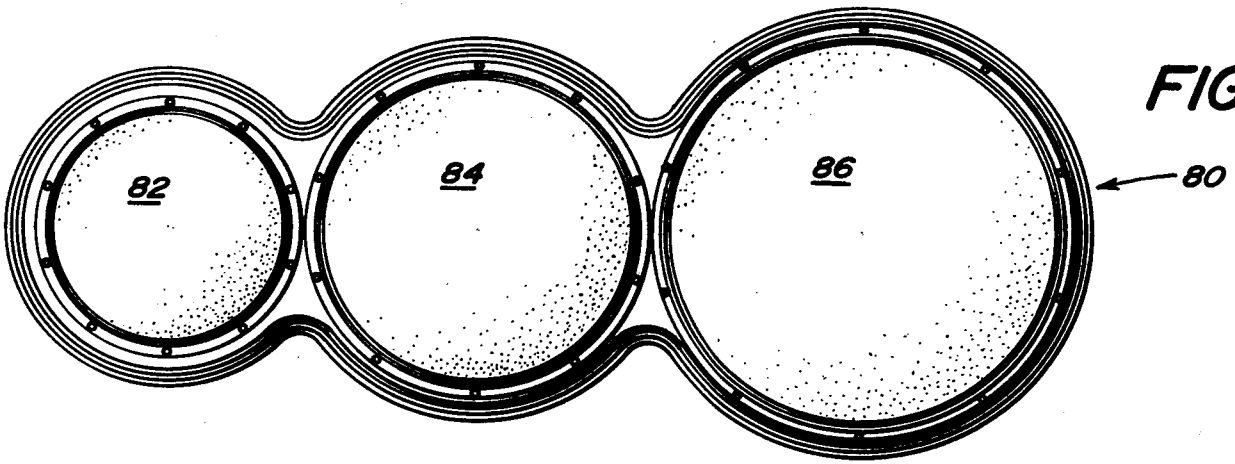
FIG. 4 is a top plan view of a collapsable drum according to the present invention having several drum sizes in the same collapsable shell.

Conventional drums neither collapse nor fold and must be carried from job-to-job in cases that are slightly larger than the drum itself. Thus, it takes a considerable amount of storage space to store the drums when they are not in use and a considerable amount of luggage space in in the transportation vehicle of the drummer.

Referring to the drawing, FIG. 1 shows a top plan view of a drum 10 according to the present invention, the drum 10 having a conventional drum head 12.

Referring to FIG. 2, the shell of the drum comprises a first or main shell ring 14 having a channel-like cross section with inwardly turned flanges 16, 18. Disposed for slidable engagement with said main or shell ring 14 is a first pair of intermediate shell rings 20, 22. Intermediate rings 20, 22 have a first or outwardly projecting lip or flange 28, 30, which are adaptable to engage flanges 16, 18 respectively of main shell ring 14 to fix the position of intermediate rings 20, 22 when the drum is open. A second inwardly turned flange 32, 34 on intermediate rings 20, 22 is adapted to meet either with an outwardly projecting lip of second intermediate rings 24, 26 or if a drum of shorter height is to be maintained, an outwardly projecting lip or flange 40, 42 of drum head supporting rings 44, 46. Drum head supporting rings 44, 46 have a vertical or first ring-like wall section 48, 50 to receive upper head 12 and lower head 13 to be stretched over the vertical portions to form the sound of the drum when struck by the conventional drumstick. Drum head supporting means 44, 46 support a plurality of conventional adjustment means 56, 58 to tension the drum heads as is well known in the drum art. Tension means 56, 58 can include upper and lower rims 60, 62. Horizontal flange portions 52, 54 of vertical depending leg portions 64, 66 of drum head supporting means 44, 46 which terminate in the horizontal lips 40, 42 engage intermediate ring portions 24, 26 or 20, 22 depending upon the height of the drum shell required. Springs such as a clothespin spring shown as 68 are disposed inside the drum spaced 180 degrees apart to urge drum head supporting rings 44, 46 away from each other and to hold the drum shell in playing position. When the drum is no longer needed for playing, pressure on the drum head supporting rings 44, 46 will collapse the drum to a position as shown in FIG. 3 wherein the intermediate rings 20, 22 or 24, 26 and the head supporting members 44, 46 are generally disposed within the height of the main or shell ring 14 providing for a compact transportable readily playable instrument that will require one-third or less for space storage than a conventional drum of equal size.

In place of springs 68, 70 a single coil spring disposed between the horizontal flange portions of drum head supporting members 44, 46 can be utilized.

Figure 5:
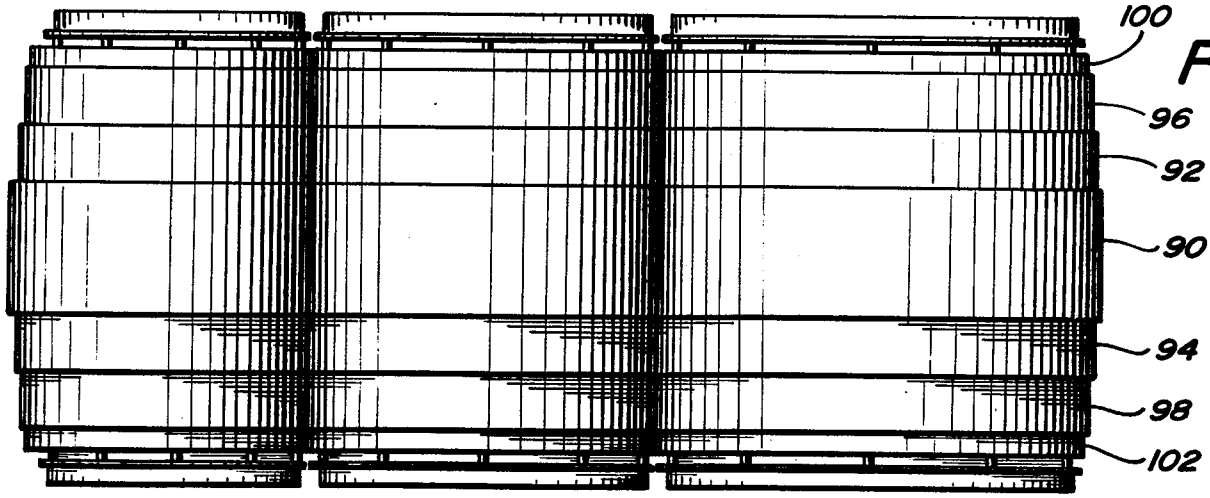
FIG. 5 is a front elevational view of the drum of FIG. 4.

Referring to FIGS. 4 and 5, there is shown a multiple drum set 80 having drum heads 82, 84, and 86 of different sizes to provide a different musical sound for each head. Multiple drum set 80 is constructed with a main shell ring or shell component 90 which may be in the shape of overlapping rings with overlapping portions removed, contiguous rings, curvilinear shape or square depending on the method of manufacture. Intermediate rings or shell components 92, 94, and 96, 98 as well as drum head support components 100, 102 and main shell ring 90 are constructed with flanges and lips in accordance with the description of the embodiment of FIGS. 1–3.

Having thus described my invention, what is desired to be secured by Letters Patent of the United States is set forth in the appended claims.

I claim:

1. In a telescoping drum of the type having a plurality of shell rings nestable to reduce the height of the drum shell from a open or playing height for storage and transportation, the improvement comprising:

a main shell ring having a channel shaped cross-section, the flanges of the channel being turned inwardly toward the inside of said drum shell;

at least one pair of intermediate shell rings having a first outwardly turned lip or flange slidable within said main shell ring and adapted to contact respective flanges of said channel as the intermediate rings are urged apart to extend the shell of said drum to playing height and an inwardly turned lip or flange at the end of each ring opposite said outwardly turned lip;

a pair of drum head supporting means having an upper vertically disposed ring portion over which a drum head can be stretched mounted on a horizontally disposed base flange portion for supporting drum head tensioning means and a lower vertically disposed ring portion depending from said base flange, said depending ring portion terminating in an outwardly projecting lip, said outwardly projecting lip of said lower depending vertical ring portion supporting said intermediate shell rings and, in cooperation with said main shell ring, maintaining the position of said intermediate rings between said main shell ring and said drum head supporting means when said drum is open; and means for maintaining the position between said heads when said drum is expanded for playing, said maintaining means including spring means disposed within said shell acting on the horizontal flange portion of said drum head supporting means.

2. A drum according to claim 1 wherein there is included a second pair of intermediate shell rings each disposed between each of said first pair of intermediate shell rings and each of said pair of said head supporting means said second pair of intermediate shell rings having a cross-sectional shape identical to said first intermediate rings but of a smaller diameter.

3. A drum according to claim 1 wherein said main shell ring, said intermediate rings and said head means define at least two drum shells of different diameter in side-by-side relation.

4. A drum according to claim 1 wherein said means for maintaining said drum in the open position includes a coil spring disposed within said shell between the horizontal flange portions of said head supporting means.

* * * * *